US005826909A

United States Patent [19]

Brommer et al.

[11] Patent Number: 5,826,909

[45] Date of Patent: Oct. 27, 1998

[54] RELOCATABLE ELECTRONIC SKI CAMBER SENSOR

[75] Inventors: Karl D. Brommer, Hampton Falls; Thomas G. Hebert, Merrimack; Peter J. Schibly, Litchfield, all of N.H.

[73] Assignee: Mountain Dynamics, Inc., Hampton Falls, N.H.

[21] Appl. No.: 717,272

[22] Filed: Sep. 20, 1996

[51] Int. Cl.[6] ..... A63C 5/06

[52] U.S. Cl. ..... 280/602; 280/309

[58] Field of Search ..... 280/602, 809, 280/815, 816, 14.2; 434/253; 73/781, 862.02, 862.53, 862.621, 862.625, 862.636, 862.637, 862.638, 862.639

[56] References Cited

U.S. PATENT DOCUMENTS

| | | | |
|---|---|---|---|
| 3,297,021 | 1/1967 | Davis et al. | 73/862.636 |
| 3,464,259 | 9/1969 | Farr | 73/781 |
| 3,485,092 | 12/1969 | Benner | 73/862.53 |
| 3,599,479 | 8/1971 | Kutsay | 73/781 |
| 4,516,110 | 5/1985 | Overmyer | 73/862.02 |
| 4,644,785 | 2/1987 | Doyle | 73/781 |
| 4,740,009 | 4/1988 | Hoelzl | 280/602 |
| 5,590,908 | 1/1997 | Carr | 280/14.2 |
| 5,775,715 | 7/1998 | Vandergrift | 280/607 |

*Primary Examiner*—Peter C. English
*Assistant Examiner*—Frank Vanaman

[57] ABSTRACT

A relocatable ski camber sensor provides active sports training for skiing and the like including levers extending from a planar surface to be sensed for camber, a force sensitive resistor affixed to one of the levers, a resilient compressible element for applying varying amounts of compressive force to the sensitive resistor, and a device for indicating a predetermined amount of sensed camber.

11 Claims, 12 Drawing Sheets

RELOCATABLE ELECTRONIC SKI CAMBER SENSOR

BACKGROUND OF THE INVENTION

1. Field of the Invention

The present invention is an electronic sensor for sports equipment where feedback signals indicating bending of a member to a specified extent is desirable. Intended applications of the sensor include alpine skiing and snowboarding.

2. Discussion of Background and Material Information

The carved turn provides the foundation for proficient skiing on modern skis. As described by Witherell and Evrard in *The Athletic Skier* by correctly applying edge angle and pressure to a ski, a good skier uses the ski's stiffness and shape to make the ski itself provide the necessary turning forces with no side-slip or skidding. Tilting the ski on edge and applying sufficient pressure will bend the ski into a reverse cambered arc, leaving a deep groove in the snow as the skier completes a turn. A good carving technique allows skiers to successfully negotiate steep and icy terrain by gaining maximum grip from the metal edges of alpine skis.

In light of the benefits, skiers use a variety of means to improve their carving skills. Lessons are invaluable for learning how to balance, edge, rotate and pressure a ski in order to make a proficient turn. The lesson process generally involves observing a demonstration by the instructor, practicing the skills, and listening to an evaluation from the instructor. This process is iterative in the sense that students observe, attempt the skill and then receive suggestions on how to modify their technique. A second popular method involves video taping the students so that they can directly observe their skiing form. Again this process is iterative in the sense that skiers must sequentially attempt the skill, observe the tape and make modifications to their technique. A third method involves practicing on special skis with exaggerated side cuts to allow students to more easily attain the first experience of carving a ski. The carving skills obtained on the special skis are then transferred and refined on more general-purpose skis.

Various methods of measuring and monitoring the bend of a member such as a ski are known in the art. U.S. Pat. No. 3,964,300 issued on Jun. 22, 1976 to John G. Howe shows a device for measuring the camber of a ski using a combination of a clamping device and a non-deflecting measuring device. U.S. Pat. No. 4,195,532 issued on Apr. 1, 1980 to Edward A. Pauls shows a device for measuring the camber of a ski using a combination of a clamping device and a gage. U.S. Pat. No. 4,474,067 issued on Oct. 2, 1984 to Howard H. Cherry and Stephen C. Wright shows a device for measuring the camber of a ski using a combination of a cantilever fixture and a motor. All of these devices are static fixtures for measuring ski bending properties on the workbench.

U.S. Pat. No. 4,516,110 issued on May 7, 1985 to Mark Overmyer shows a device for measuring the camber of a ski while skiing, using a pair of strain gages bonded on the front and rear of the skis. Means are provided for measuring the differential strain between the two sensors and providing auditory or visual feedback to the skier. While the static devices mentioned are intended for evaluation of skis, Overmyer's device is intended for monitoring by the skier during a ski run as a means of instruction or otherwise improving skiing technique.

Strain gages are a generally accepted method of measuring ski bend as exemplified by the *Omega Engineering Force and Pressure Handbook* (1996), which includes technical notes on the use of strain gages on skis. Such strain gauges are rigidly bonded to the element being monitored and employ instrumentation amplifiers to measure the small signal levels characteristic of the devices.

SUMMARY OF THE INVENTION

Accordingly, it is an object of the present invention to provide a device that enables skiers to monitor their ability to reverse camber a ski and thereby effectively carve turns in snow.

Another object of the present invention is to provide a self-contained sensor which is capable of measuring local bend on a ski.

Yet another object of the present invention is to provide a portable, removable and relocatable device to tolerate installation using a temporary adhesive or mounting fixture.

A further object of the present invention is to provide a sensor with sufficient signal level and dynamic range to operate on a wide variety of terrain and at a wide variety of ability levels.

A still further object of the invention is to provide a sensor constructed with generic operational amplifiers rather than relatively expensive instrumentation amplifiers.

Another object of the invention is to provide means for a skier to set a threshold to control the level of audio feedback consistent with the skier's skill level in carving a ski.

Another object of the invention is to provide means to transmit the sensor output from the skier to a remote data recording device using a telemetry system.

Other objects and advantages will become clearer upon reading the description that follows.

The present invention provides a device for sensing an amount of bend of a ski or similar planar sports equipment, comprising means for removably affixing the device to a planar surface such as a top surface of a ski or snowboard, first and second lever means extending generally perpendicularly from the planar surface when the device is affixed thereto and adapted to remain generally perpendicular to the planar surface during bending thereof, a force sensitive resistor affixed to the first lever means, a resilient compressible element adapted to apply varying amounts of compressive force from the second lever means to the force sensitive resistor in response to bending of the planar surface and relative movement between the first and second levers, and means responsive to the force sensitive resistor for indicating when the device has sensed a predetermined amount of bend.

In a refinement, the compressible element includes a mechanical biasing means for applying an adjustable amount of pressure against the force sensitive resistor. Further refinements include an audible feedback signal from the means for indicating and means for adjusting the predetermined amount of bend which is sensed to accommodate a variety of variable conditions.

BRIEF DESCRIPTION OF THE DRAWINGS

The present invention is illustratively described in reference to several embodiments shown in the accompanying drawings.

DETAILED DESCRIPTION OF THE PREFERRED EMBODIMENTS

Figure 1:
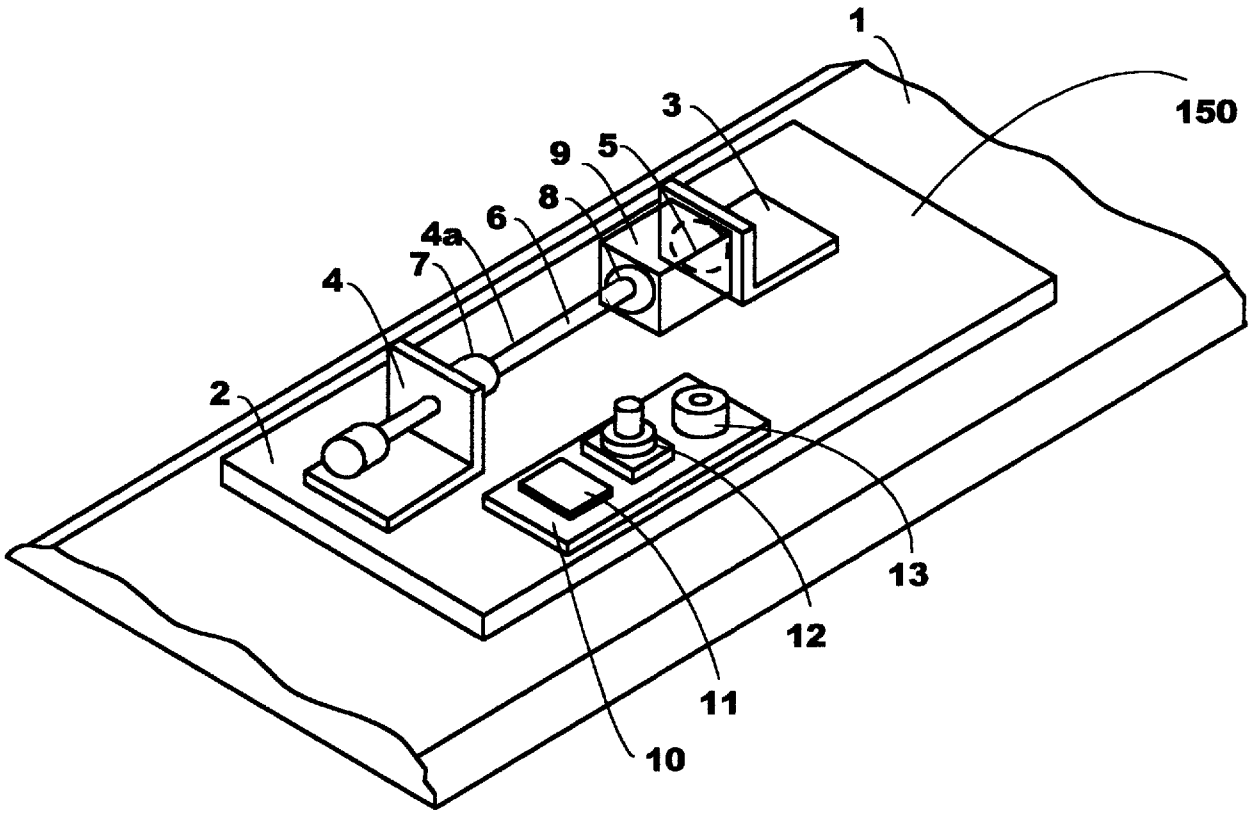
FIG. 1 illustrates an overview of the electronic camber sensor constructed in accordance with one embodiment of the present invention and mounted on a ski with its protective enclosure removed.

FIG. 1 shows a perspective view of the electronic bend sensor 150 mounted on top of an alpine ski 1. The bend sensor components include a pair of levers 3,4 and a sensing element 5. Levers 3,4 are mounted on a flexible plate 2 which is attached directly to the ski 1. Bending the ski 1 tilts levers 3 and 4 together. A force sensing element 5 is attached to lever 3. Sensing element 5 may be a force-sensitive resistor, a thin-film electronic device whose resistance decreases as increasing force is applied to its surface. Attached to lever 4 is an actuating element 4*a* for applying force to sensing element 5. Actuating element 4*a* includes a compression screw 6 mounted through a threaded attachment 7 in lever 4. The compression screw 6 is connected to an anvil 8 made from metal, plastic or any similarly rigid material. When levers 3,4 compress toward each other, the anvil 8 applies pressure against a temperature-insensitive elastomer 9 mounted against the force-sensing element. The hardness and thickness of the elastomer 9 are chosen so that a ski bending over its complete range of excursion drives the force-sensitive element through its complete dynamic sense range. Neoprene and EPDM (ethylene propene diene) are two examples of elastomeric materials with appropriate hardness and temperature stability. Polymers with similar properties are also appropriate.

The elastomer 9, anvil 8, compression screw 6 and attachment 7 form a resilient, compressible element adapted to apply varying amounts of compressive force from the lever 4 to the force sensitive element 5. Compression screw 6 mechanically biases the force sensitive element with an adjustable amount of force. The compression screw 6 is tightened to the extent where a flat ski puts the force-sensitive element 5 into its operating range.

The force sensitive element 5 is connected to a thresholding and audio feedback circuit 10 mounted adjacent to levers 3,4. The principal elements of the circuit are an electronic comparator 11, a biasing device 12 for setting the bending threshold for audio feedback and an audio transducer 13. This circuit 10 allows the skier to set a desired degree of ski bend, with the audio transducer emitting sound whenever the desired degree of ski bend has been exceeded. The device is enclosed in a protective housing with flexible attachment links in a manner shown in subsequent figures.

Figure 2:
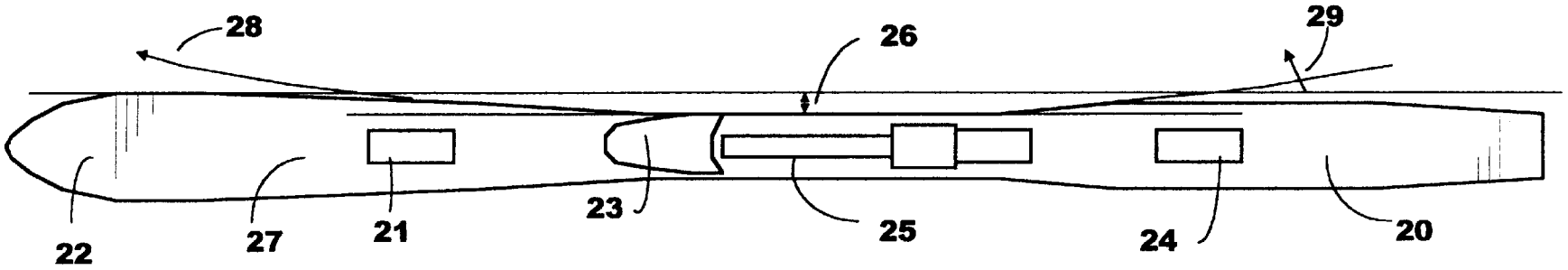
FIG. 2 identifies the sensor mounting positions on the front and rear of a ski.

FIG. 2 shows possible mounting locations for the bending sensor 150 along the length of an alpine ski 20. A forward mounting location 21 is located between the tip 22 and binding toe piece 23. This position enables the skier to monitor bending of the ski tip during the course of a turn. A rearward mounting location 24 enables the skier to monitor bending of the ski tail during the course of a turn. In one possible use of the sensor 150, a less skilled skier may use the forward mounting position 21 to develop an ability to bend their skis during a turn. An alpine ski is designed with a side cut 26 consisting of the difference between its width at the shovel 27 and its width at the waist 25. With the aid of this side cut, tipping the ski on its edge while bending the front of the ski, causes it to carve a turn in an arc 28. Mounting the bending sensor 150 in the forward position 21 helps a beginner practice carving turns by telling him when the ski is properly bent in a reverse camber.

In a second possible use of the sensor, a more advanced skier may apply the device to the rearward mounting location to monitor the degree of bending of the ski tail 30 during the course of a turn. Skiers who are in the process of developing strong carving skills tend to be proficient at tipping the ski and bending the ski shovel to initiate a carved turn. The next skill required to complete a carved turn is to maintain the bend until the turn is complete. It is difficult to prevent the tail of the ski from decambering and skidding perpendicular to arc 28 in direction 29. This skidding action which results in a simultaneous loss of speed and control near the conclusion of a turn may be detected by using of the electronic bending sensor in the rearward position.

In a third possible use of the sensor a racer or other advanced skier might mount sensors simultaneously in the forward and rearward mounting positions. Timing the audio signals from the two sensors gives an indication of when the racer is bending the tips and tails of the ski with respect to the ski's path around a racing gate.

Figure 3:
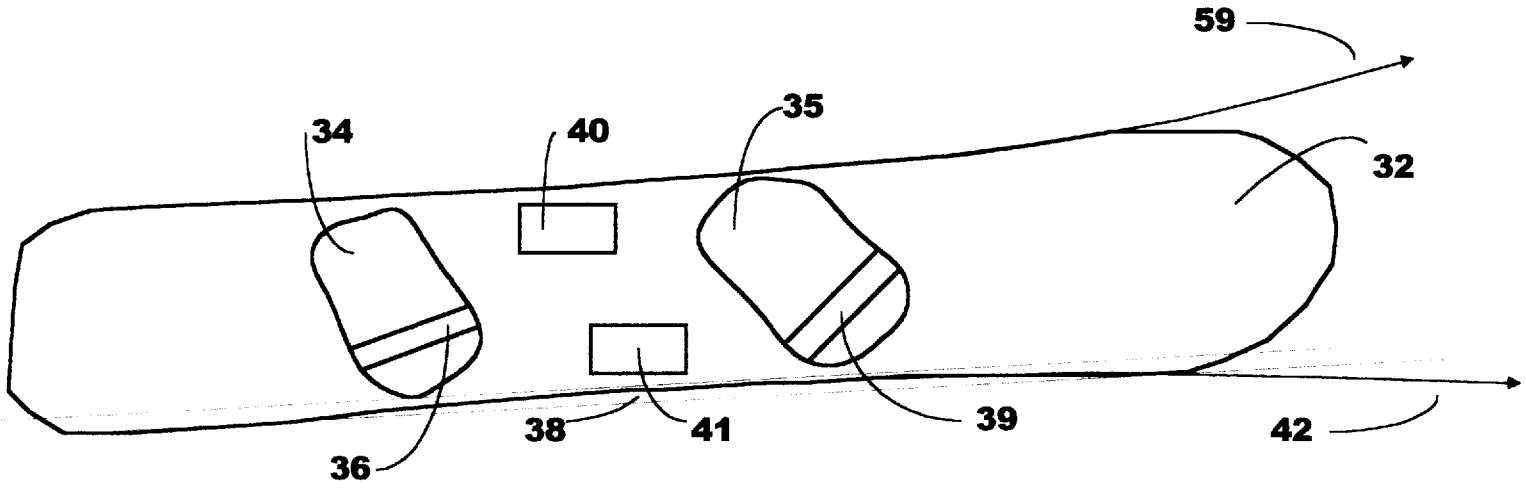
FIG. 3 identifies the sensor mounting positions on a snowboard.

FIG. 3 shows the mounting locations 40 and 41 for the bending sensor 150 on a snowboard 32. The device is mounted between the boot bindings 34 and 35 with toe straps 36 and 39 shown in the drawing. Turning a snowboard also requires tipping the board to utilize its side cut 38 in a manner similar to that described for the alpine ski in FIG. 2. As with the ski, tipping the snowboard 32 causes it to bend, which is detected by a bending sensor mounted as shown. Audio feedback from the bending sensor enables beginning snowboarders to develop their ability to tip and bend the board to turn it along the trajectories 42 and 59. Mounting position 40 is intended for beginners who are learning how to turn while leaning backward on the snowboard. Mounting position 41 is intended for advanced snowboarders who are learning how to turn while leaning forward on the snowboard.

Figure 4:
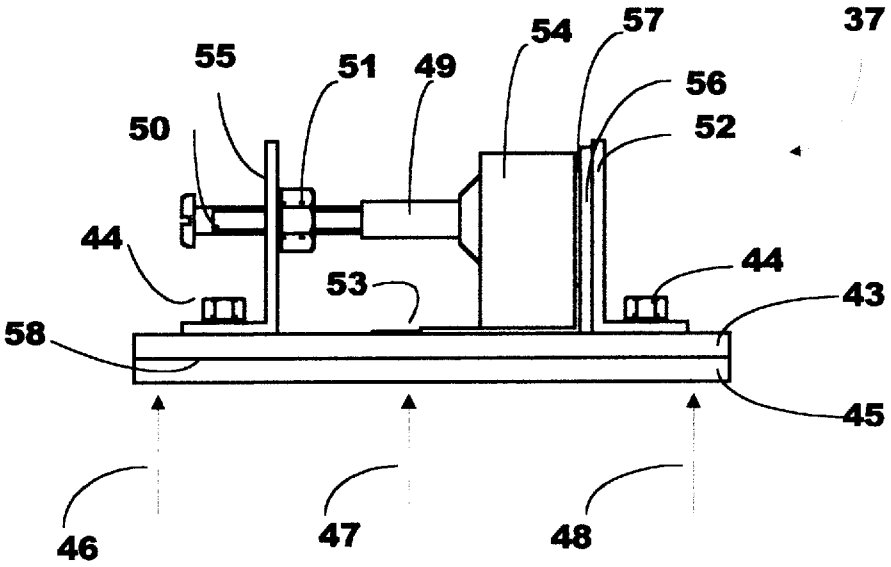
FIG. 4 illustrates the details of the mechanical portion of a sensor constructed in accordance with another embodiment of the present invention including flexible base plate, levers, elastomer, pre-stressing device and force-sensitive resistor.

FIG. 4 shows the mechanical components of a bending sensor 37. Two levers 55 and 52 are mounted to a flexible plate 43 using screws 44 or other fastening methods. The flexible plate 43 is either glued directly to the top surface of the ski by an adhesive layer 58 or fastened to a flexible mounting plate 45. The mounting plate is fastened to the ski using screws, adhesive or a mounting fixture. In this embodiment the flexible plate is fastened to the mounting plate through forward 46, central 47 and rearward 48 fastening points. Lever 55 mounts an anvil 49 fastened to a screw 50 through fastening point 51 connected to the lever 55. The screw is used to adjust the compression on an elastomer 54 connected to a force sensing element 57. The force sensing element 57 is glued to a mounting plate 56 attached to lever 52. The resistance of the force sensing element 57 is monitored through an electrical circuit which connects to the sensor leads 53.

Figure 5:
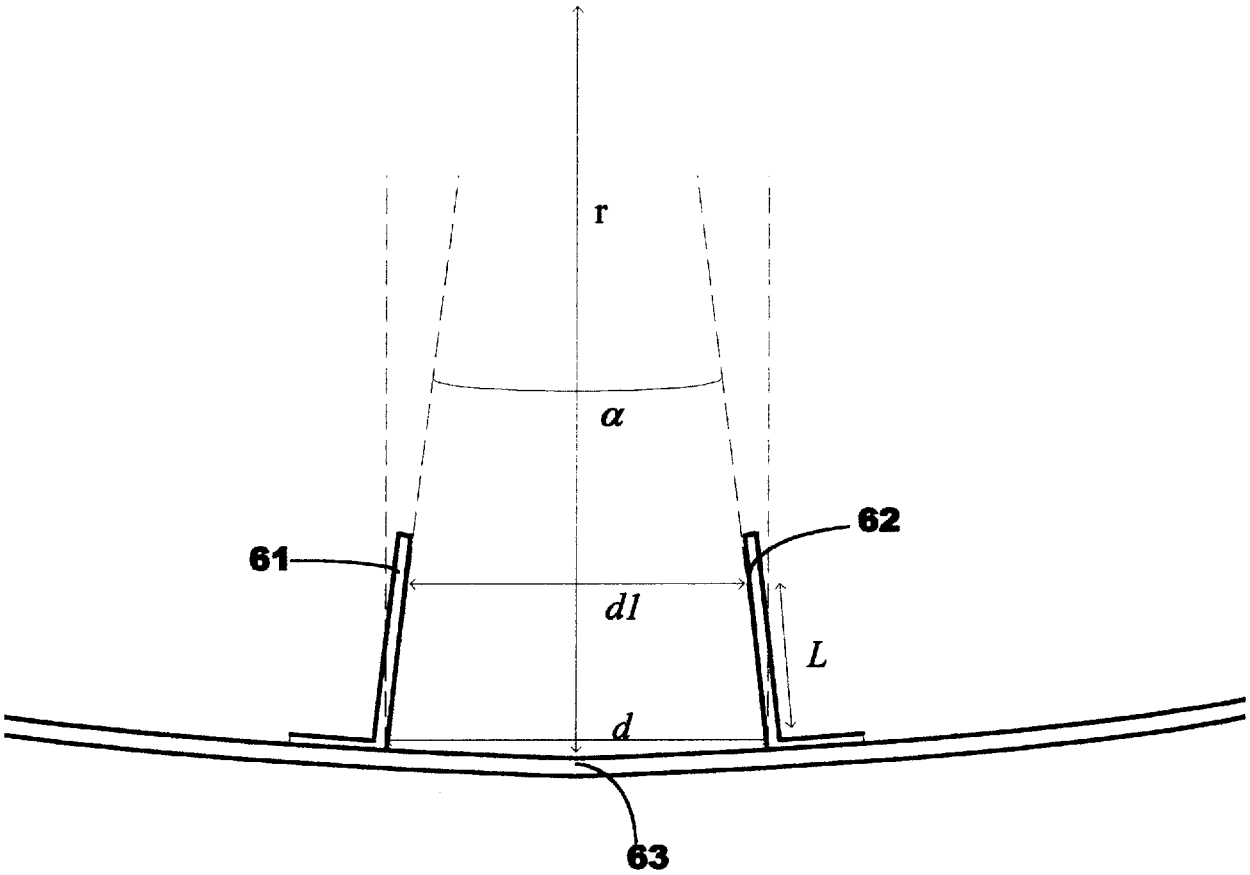
FIG. 5 is a schematic diagram of the geometric principles underlying the mechanical sensors of the previous embodiments.

FIG. 5 shows the dynamic parameters of the mechanical components of the bending sensor during bending of the ski into an arc of radius r. The actuating levers 61 and 62 are rigidly fastened to the mounting plate 63 at a fixed separation distance d. At the actuator and sensor mounting height L, the ski bend contracts the lever spacing, reducing the distance between the levers to d1. The difference between d and d1 is an amount δ given by $$\delta = dL/r$$

Large displacements increase the degree of load on the force sensor, thereby reducing the sensitivity requirements and cost. The equation shows that the design objective of maximizing the lever displacement δ for a given degree of ski bend as quantified by turning radius r is achieved by maximizing the lever height L and the lever spacing d.

Figure 6:
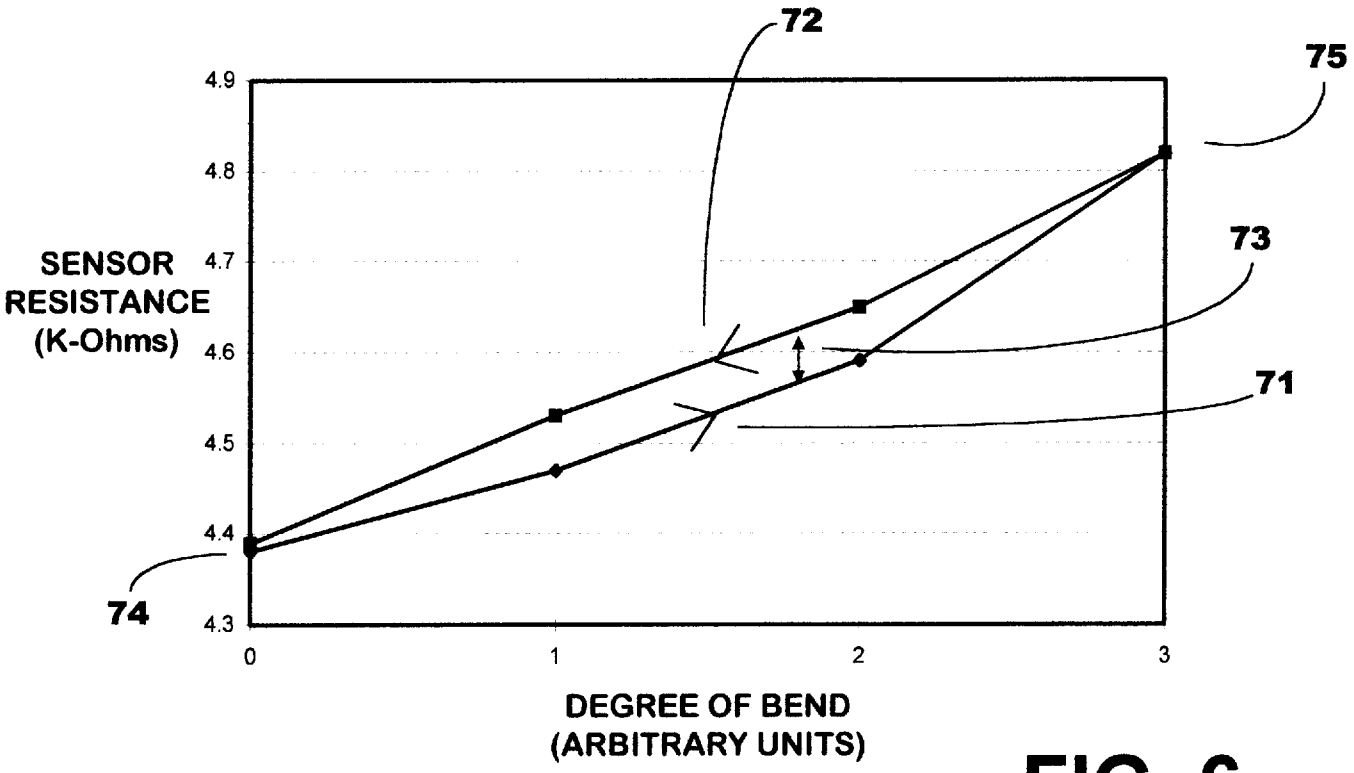
FIG. 6 shows a typical hysteresis curve obtained from the sensor due to adhesive creep.

FIG. 6 shows the hysteresis exhibited by the sensor 150,37 when it is temporarily mounted on the ski using ordinary adhesive. This curve shows the resistance of the force-sensing element 5 versus degree of bend during one complete cycle from flat 74 to bent 75 to flat again. The lower line 71 shows the resistance vs. bending as the ski is bent. The higher line 72 shows the resistance vs. bending as the ski is relaxed. The difference in height 73 at any degree of bending is due to stretching of the glue adhering the device to the ski. In order to satisfy the object of the invention of having an easily removable sensing device, the sensor excursion δ must be sufficiently large to accommodate the measurement degradation due to adhesive visco-elastic creep. As discussed in FIG. 4, the lever height L and spacing d must be sufficiently large so that changes in bend measurements over repeated bends due to adhesive slip is small. In a practical situation, pressing the unit firnly against the top surface of the ski is sufficient to make the sensor noise due to glue creep small compared to the sensor signal due to actuator displacement δ against the force-sensing element.

Figure 7:
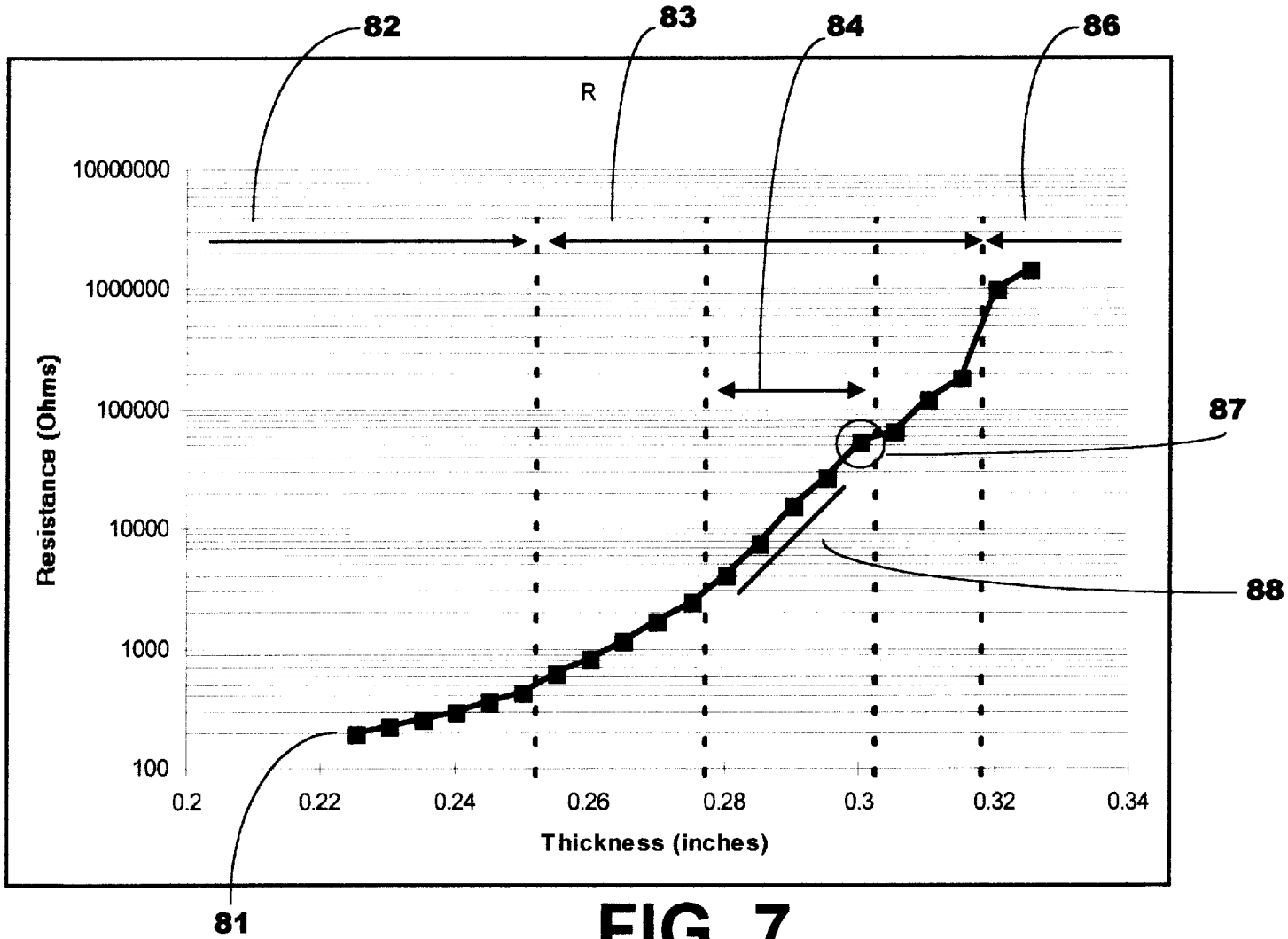
FIG. 7 shows a typical sensor response curve with an inactive region, an active region and a saturation region.

FIG. 7 shows the response of a typical elastomer and force sensor design as the actuator anvil is displaced into the elastomer in terms of sensor resistance vs. actuator displacement. The full excursion δ of the anvil is calculated from the minimum bending radius r, baseline d and lever height L. Using a one-inch baseline and a one-half inch lever height on a typical ski results in a maximum excursion of about 0.040 inches when the sensor is mounted on the front of the ski. The curve 81 shows the sensor resistance as a function of spacing between the anvil 8 and the force-sensing resistor, or equivalently, the thickness of the compressed elastomer 9. There are three regions to the curve. The left section 82 corresponds to when the anvil 8 compresses the elastomer 9 to a high degree. In this region the sensor response, while monotonic with anvil displacement is relatively flat. As the anvil 8 is disengaged from the elastomer 9, the sensor response as defined by change in sensor resistance per unit of displacement increases. The region 84 enclosing the maximum slope 88 of the response curve defines the center of the desired operating region 83 where the sensor exhibits maximum dynamic response. The full excursion of a typical ski from flat to fully bent shovel position 84 is shown to fall well within the operating region. If the anvil is displaced too far out of the elastomer, the sensor resistance increases abruptly. This change indicates that the anvil has disengaged from the force-sensing resistor, resulting in an effective open-circuit condition. This part of the curve is labeled as the disengagement region 86. An appropriate elastomer for use in the bend sensor will exhibit hardness and be cut to a thickness to produce a response curve similar to this figure. Other criteria include temperature-insensitive hardness for operation over a range of weather and snow conditions, and a high degree of elasticity so that the elastomer does not contribute to the sensor hysteresis in a manner similar to the adhesive hysteresis shown in FIG. 6. The actuator screw should be tightened to compress the sensor to load point 87, approximately 0.020 inches to the right of the center of the operating region when the ski is flat.

Figure 8:
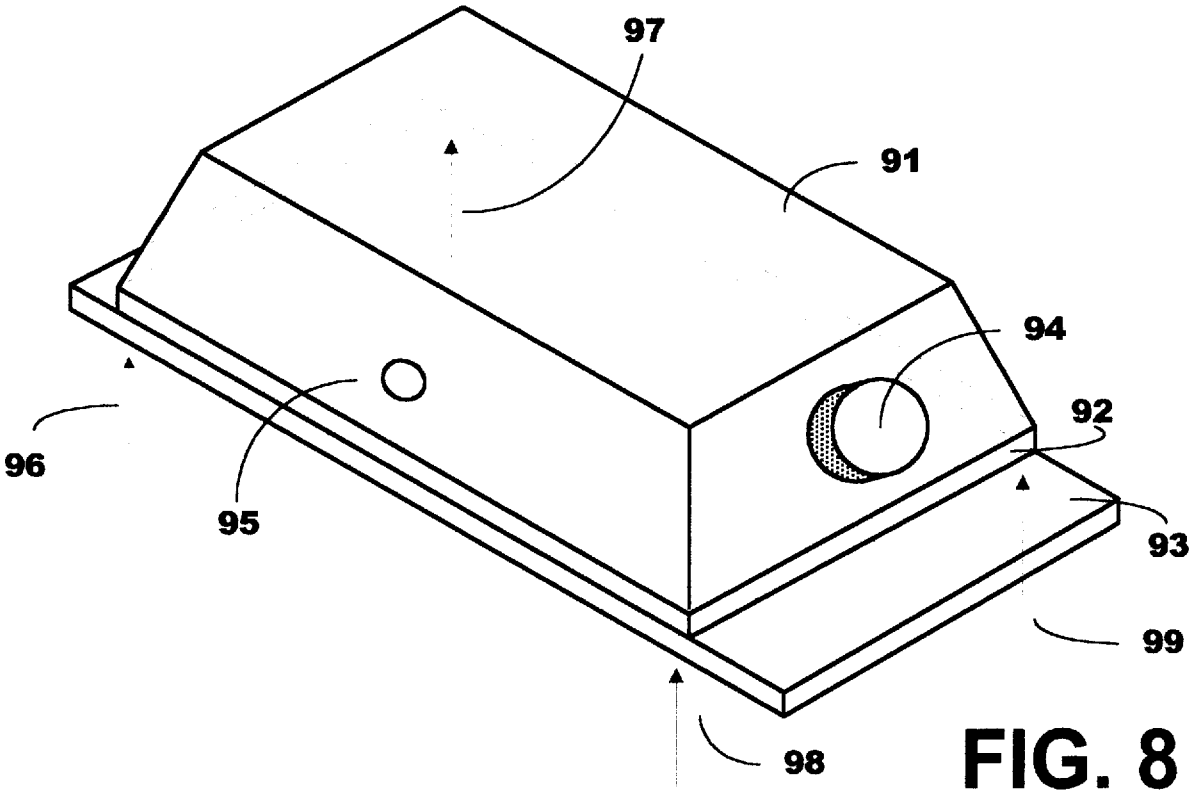
FIG. 8 illustrates an embodiment of the electronics enclosure using a flexible sealing gasket to prevent inhibition of ski bend by the device and to prevent moisture from entering the device.

FIG. 8 shows an embodiment of the electronics enclosure 91 using a flexible sealing gasket 92 to prevent inhibition of ski bend by the device and to prevent moisture from entering the device. The enclosure 91 consists of a hard plastic or metal box covering the mechanical levers mounted to the base plate 93. The threshold electronics and battery are mounted inside the cover of the box. The force-sensitive resistor is connected to the electronics inside the box. A knob 94 on the outside of the box provides means to set the variable bend threshold. A hole 95 provides an aperture for audio feedback from the transducer whenever the bend threshold is exceeded. The entire device including the mounting plate, gasket, enclosure, knob and aperture is sealed against water and snow. Screws may be used at locations 96, 97, 98 and 99 to fasten the enclosure to the flexible plate. Alternatively, glue or any other adhesive may be used.

Figure 9:
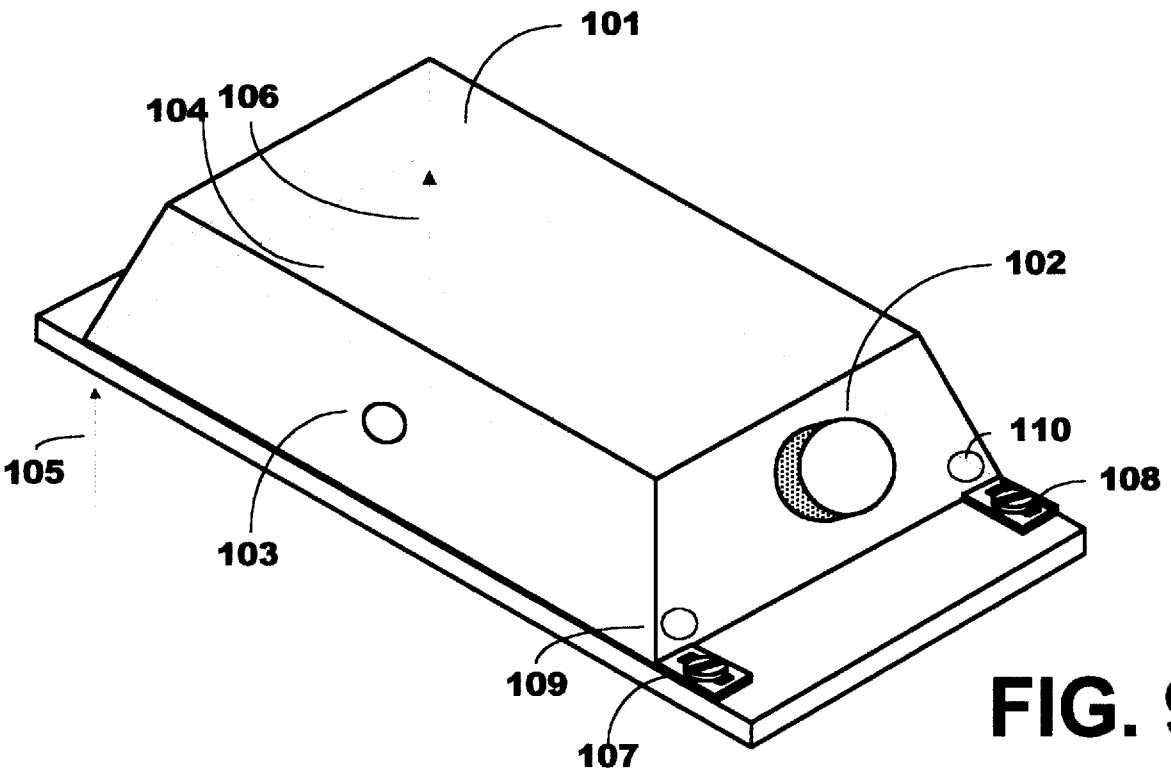
FIG. 9 shows another form of the electronics enclosure using sliding links to prevent inhibition of ski bend by the device.

FIG. 9 shows an alternative embodiment of the electronics enclosure. The housing 101 is identical to FIG. 8 and the electronics, knob 102 and aperture 103 are the same as in FIG. 8. In this alternative embodiment the bending levers fit through a slot 104 in the bottom of the housing. This housing is rigidly fastened to the front of the mounting plate with two screws at location 105,106 or an adhesive. The rear of the plate is fastened with a slipping mechanism consisting of two thin plates 107,108 fastened to the housing on one end and fastened to the mounting plate on the other with oblong holes permitting 0.100" of excursion in either direction as the ski bends. Alternative techniques using slides or plastic slots would be familiar to those skilled in the art. This embodiment also includes 1/32" drainage holes 109,110 near the rear of the housing. The internal electronics are sealed with potting compound and water and condensation are free to enter and leave the case through the drainage holes.

Figure 10:
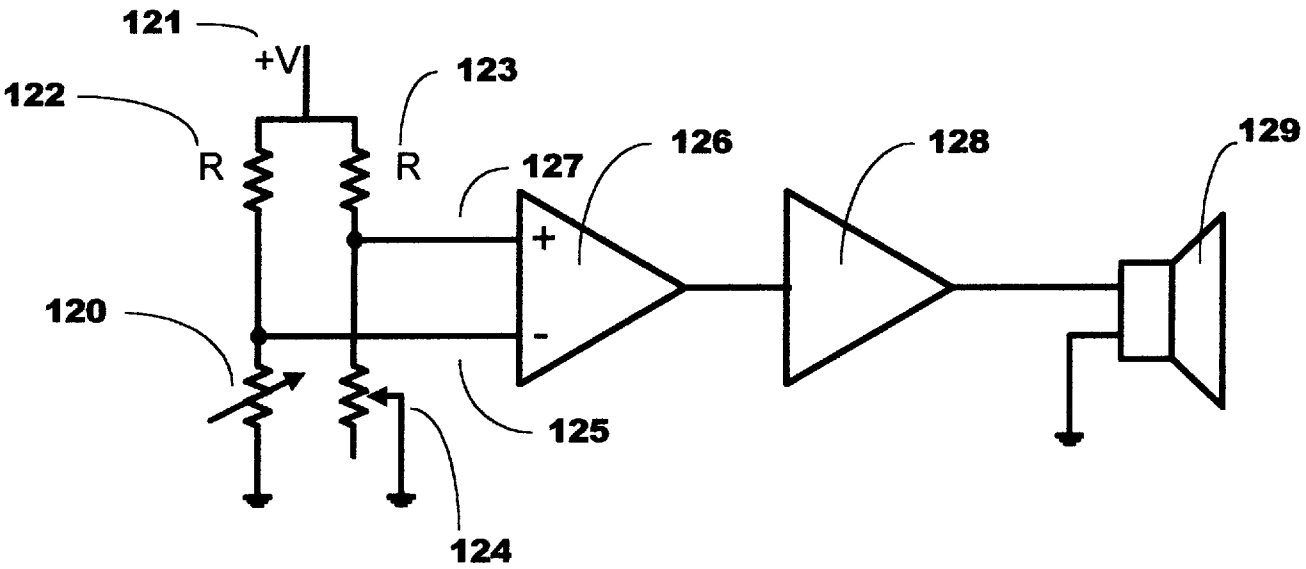
FIG. 10 is the electronic circuit diagram of the bend threshold detection and audio feedback component suitable for use with the previous embodiments.

FIG. 10 shows a schematic diagram of the sensor electronics. The bend sensor 120 decreases its resistance as the ski bend increases. The resistance is converted to a voltage signal by means of a voltage divider consisting of a reference voltage 121 and a reference resistance 122. The reference resistance 122 is chosen to have the same nominal value as the operating resistance of the sensor. As the ski bends, the sensor voltage will decrease. A second voltage divider consisting of the same reference voltage 121, a reference resistor 123 with the same nominal resistance and a variable resistor 124 maintains an adjustable threshold voltage signal. The sensor voltage is connected to the negative input 125 of an electrical comparator 126. The threshold voltage is connected to the positive input 127. When the ski bends to the extent where the sensor voltage falls below the threshold voltage, the electrical comparator produces a nonzero output voltage, exciting an audio amplifier 128. The audio amplifier drives a transducer 129, providing an audio signal indicating to the skier that the ski has been bent to the desired extent. By varying the threshold resistance in variable resistor 124, the skier may set the degree of ski bend necessary to produce output from the transducer.

It will be apparent to those skilled in the art that a variety of electrical components may be used to construct the sensor electronics. A typical comparator such as the LM393 available from a variety of manufacturers exhibits sufficient performance for application in the present device. The audio amplifier may be a single transistor with sufficient current rating to drive the transducer. The transducer may be taken from those available for a number of different products including pagers, smoke detectors, etc. If a low-power transducer is selected, it is possible to perform the comparator and amplifier functions with a single device such as the LM358.

Figure 11:
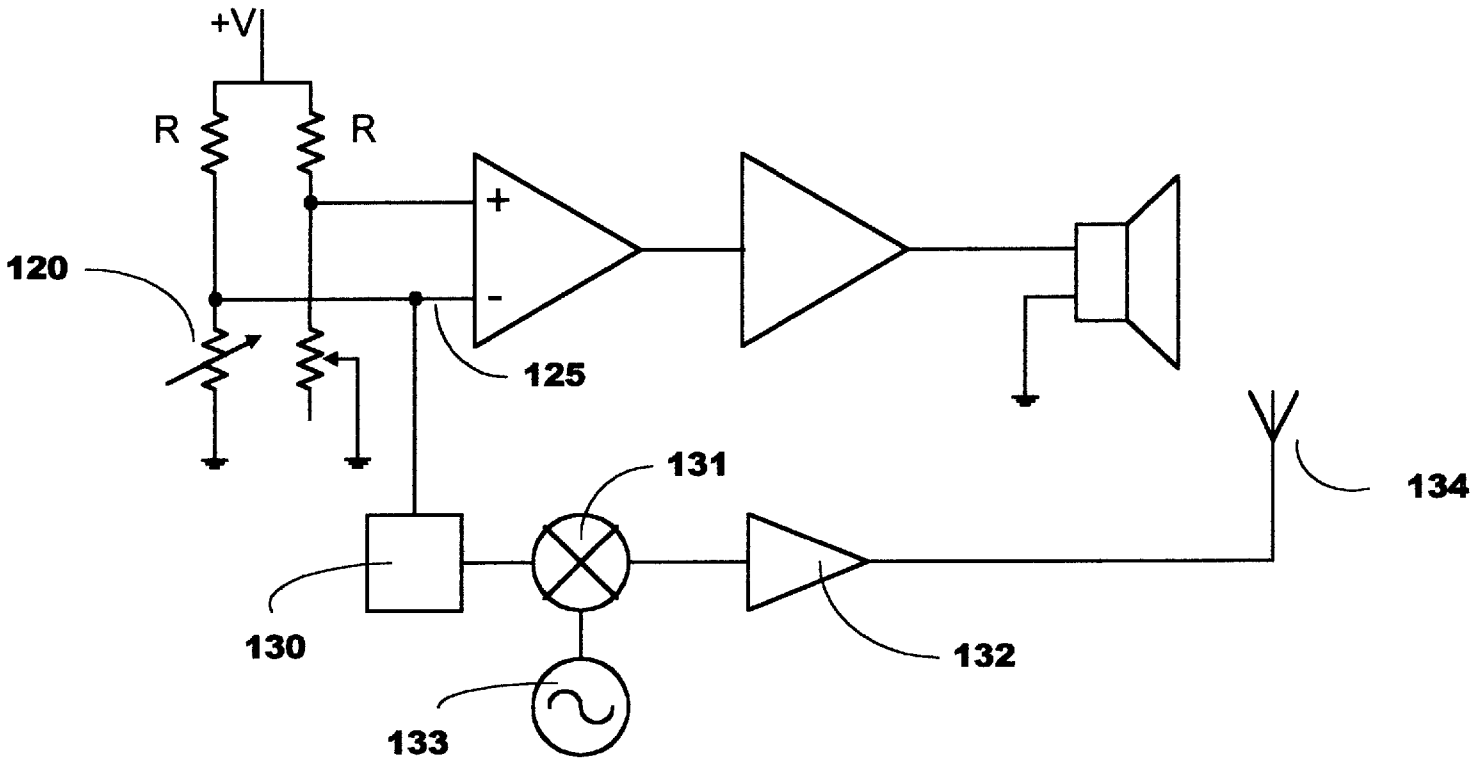
FIG. 11 is a modified circuit diagram with telemetry outputs from the device for integration with a remote data recording system.

FIG. 11 shows the sensor electronics configured to transmit the ski bending signal to a remote data collection system. The line connecting the sensor 120 to the negative comparator input 125 is also input to a modulator 130 such as a voltage controlled oscillator, amplitude modulator or digital encoder. The modulator 130 is input to a radio transmitter consisting of an up-converter 131 and a radio amplifier 132. The up-converter 131 translates the modulated sensor voltage to the carrier frequency determined by a local oscillator 133. The amplifier 132 excites a transmission antenna 134 which broadcasts the ski bend data to a remote receiver. The receiver tunes and demodulates the radio signal, thereby recovering the ski bend for recording on a data storage device such as a digitizer or tape recorder. The data may be reviewed in conjunction with video recordings of the skier's performance.

Figure 12:
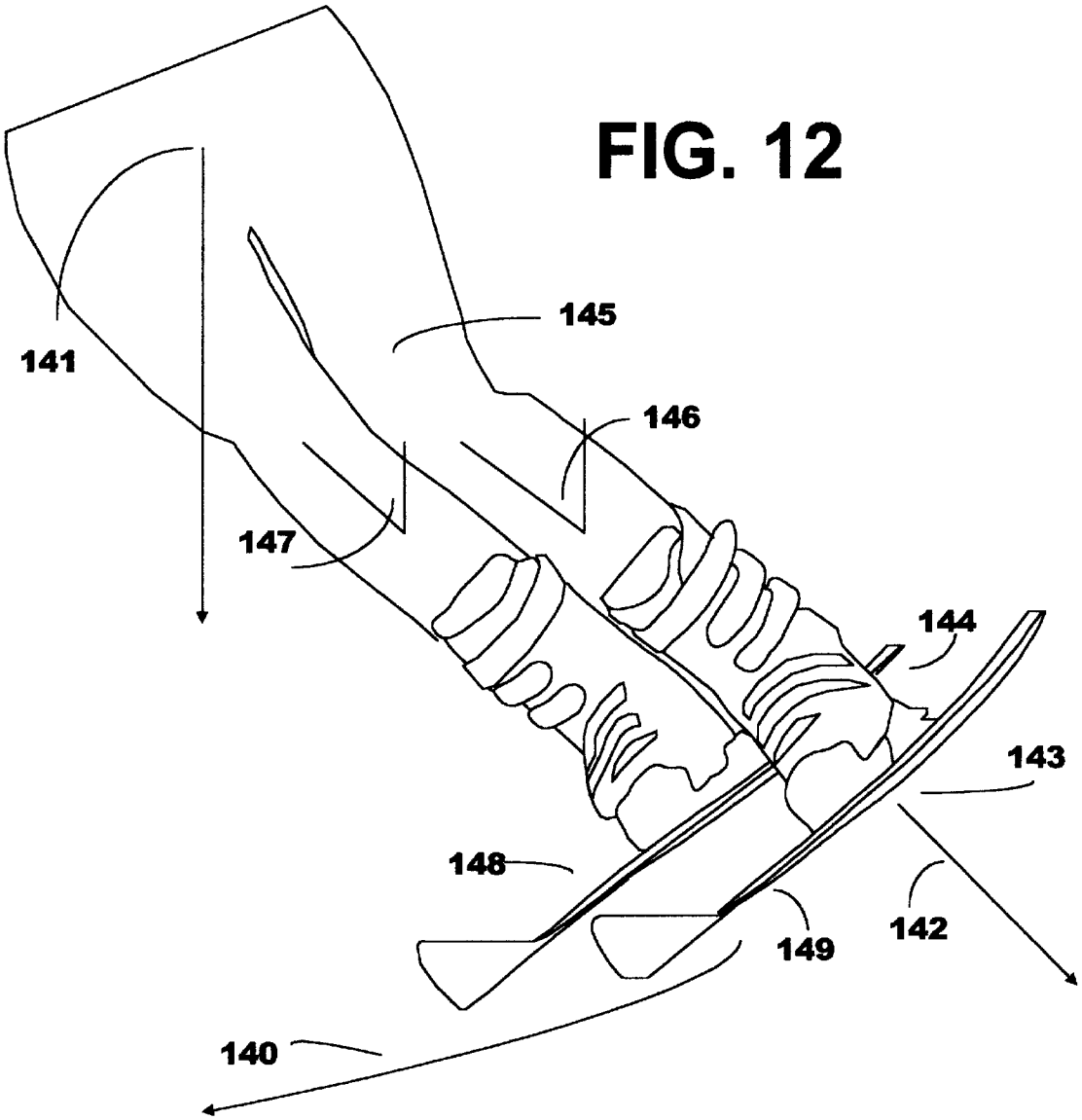
FIG. 12 shows how a skier maintains reverse camber during a carved turn.

FIG. 12 shows how a proficient skier carves a turn. In this diagram, the skier is turning to her right along the arc shown 140. The skier's center of mass 141 falls inside the turning arc to counter the centrifugal force 142 of the turn. This action tilts and pressures the skis so that the inside edges 148 and 149 engage the snow. The effect of edging and pressure is to bend the skis into reverse cambered arcs. The outside ski 143 is reverse cambered more strongly than the inside ski 144, indicating that most of the turning force is provided by this ski. The extra reverse camber of the outside ski is effected by means of additional flexion and abduction of the left knee 145 as indicated by a larger inclination of the lower left leg 146 in the plane of the diagram as compared to the right leg 147. By measuring the degree of ski bend our device may be used to develop and enhance bending, pressuring and turning skills.

The present invention thus provides a very useful yet simple device for the active training of skiers and the like, by being readily useable and reusable with a variety of equipment, users, skill levels, and performance conditions. One or two devices can be easily be used and reused within a diverse group of individuals, such as a family, which might include advanced, intermediate, beginner and over-the-hill skiers, or even a snowboarder. The simplicity of the invention saves costs as well as wear and tear in a collision prone environment.

The embodiments described above are intended to be taken in an illustrative and not a limiting sense. Various modifications and changes may be made to the above embodiments by persons skilled in the art without departing from the scope of the present invention as defined in the appended claims. For example, either of the levers 3,4 may be replaced by some form of electronics packaging which performs the same lever function of remaining substantially perpendicular to the local planar surface.

What is claimed is:

1. A device for sensing an amount of bend of a ski or similar sports equipment having a bendable planar surface, comprising:

first and second lever means adapted to extend generally perpendicularly from thc planar surface when the device is affixed to the planar surface;

means for removeably affixing the first and second lever means to the planar surface and thereupon for maintaining each of the first and second lever means generally perpendicular to the planar surface during bending thereof;

a force sensitive resistor affixed to the first lever means;

a resilient compressible element adapted to apply varying amounts of compressive force from the second lever means to the force sensitive resistor in response to bending of the planar surface and relative movement between the first and second levers; and means responsive to the force sensitive resistor for indicating when the device has sensed a predetermined amount of bend.

2. The device of claim 1, wherein the resilient, compressible element includes a mechanical biasing means for applying an adjustable amount of pressure against the force sensitive resistor.

3. The device of claim 2, wherein the biasing means is adapted to engage the second lever means, and further wherein the resilient, compressible element includes a block of elastomer adapted to be pressured by the biasing means against the force sensitive resistor.

4. The device of claim 3, wherein the means for indicating includes electrical means adapted to compare the resistance of the force sensitive resistor to a reference and provide an indication of such comparing.

5. The device of claim 4, wherein the reference includes an adjustable resistor adapted to vary over a range corresponding to a range of bending as represented by the force sensitive resistor.

6. The device of claim 5, wherein the means for indicating includes an audible indicator.

7. The device of claim 6, wherein the adjustable resistor is adapted to be varied by a skier for adjustment to different amounts of indicated bend.

8. The device of claim 7, further comprising radio telemetry means for transmitting data responsive to the comparing of the force sensitive resistor and the reference.

9. The device of claim 1, wherein the means for removeably affixing includes a flexible plate means affixed to the first and second lever means and adapted to be removeably affixed to the planar surface.

10. The device of claim 9, wherein the flexible plate means includes adhesive means for removeably affixing the device to a bendable planar surface.

11. The device of claim 10, wherein the sports equipment is a snow ski or snow board.

* * * * *